United States Patent [19]

Thayer

[11] 4,127,052

[45] Nov. 28, 1978

[54] FLEXIBLE TUBE VALVE

[76] Inventor: Orla E. Thayer, P.O. Box 473, Waldport, Oreg. 97394

[21] Appl. No.: 815,578

[22] Filed: Jul. 14, 1977

[51] Int. Cl.[2] ..... G10D 9/04
[52] U.S. Cl. ..... 84/388
[58] Field of Search ..... 84/387–394

[56] References Cited

U.S. PATENT DOCUMENTS

| | | | |
|---|---|---|---|
| 924,250 | 6/1909 | Low | 84/388 |
| 3,933,078 | 1/1976 | Veneklasen | 84/387 |

*Primary Examiner*—Lawrence R. Franklin
*Attorney, Agent, or Firm*—Klarquist, Sparkman, Campbell, Leigh, Hall & Whinston

[57] ABSTRACT

A musical instrument valve having two flexible, movable sound tubes in a casing is disclosed. By actuating a finger button, a musician can reposition the tubes to include a slide loop in the instrument's sound path.

15 Claims, 11 Drawing Figures

FIG. 1
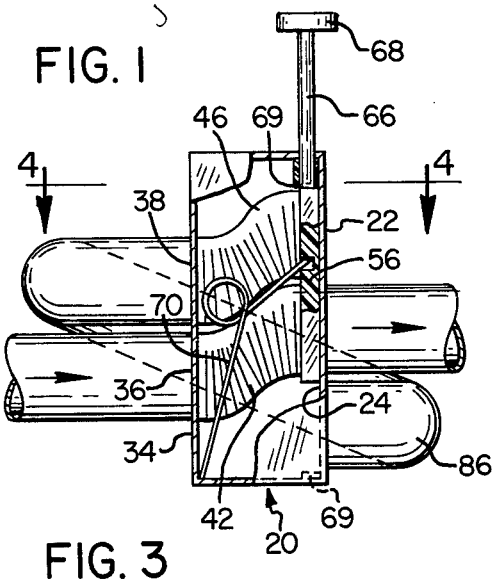
FIG. 2
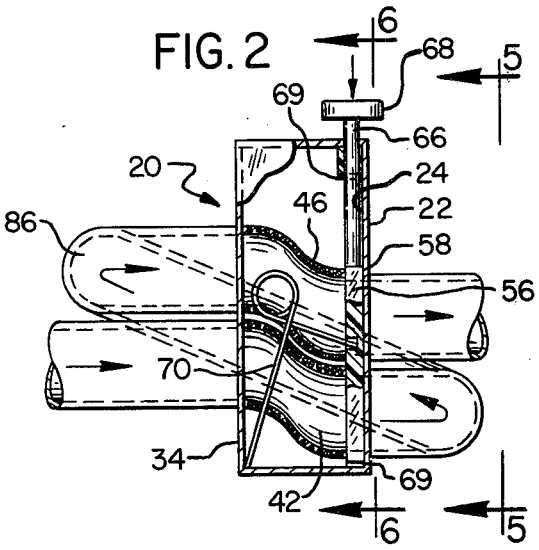
FIG. 3
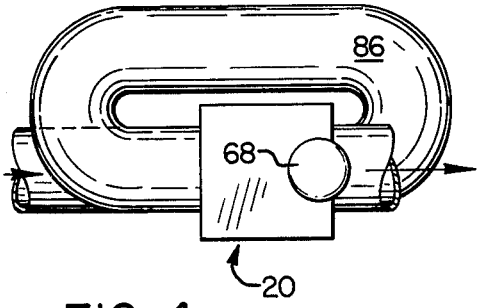
FIG. 4
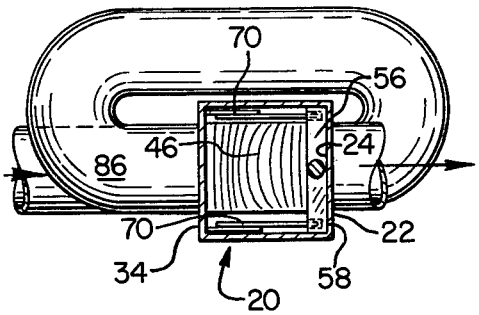
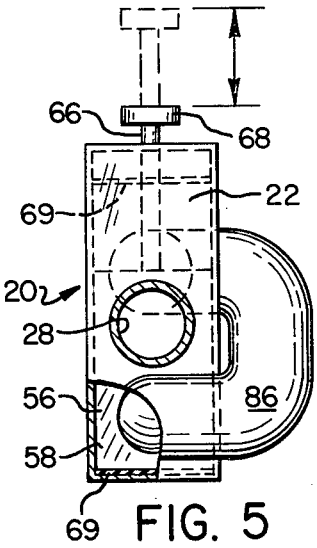
FIG. 5
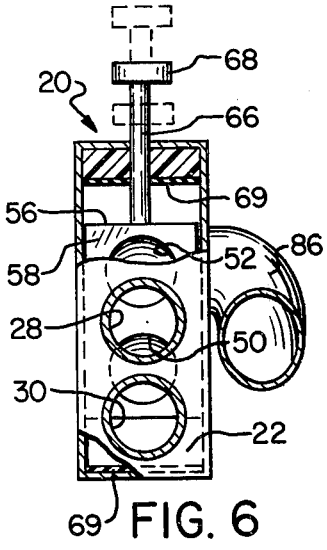
FIG. 6
FIG. 8
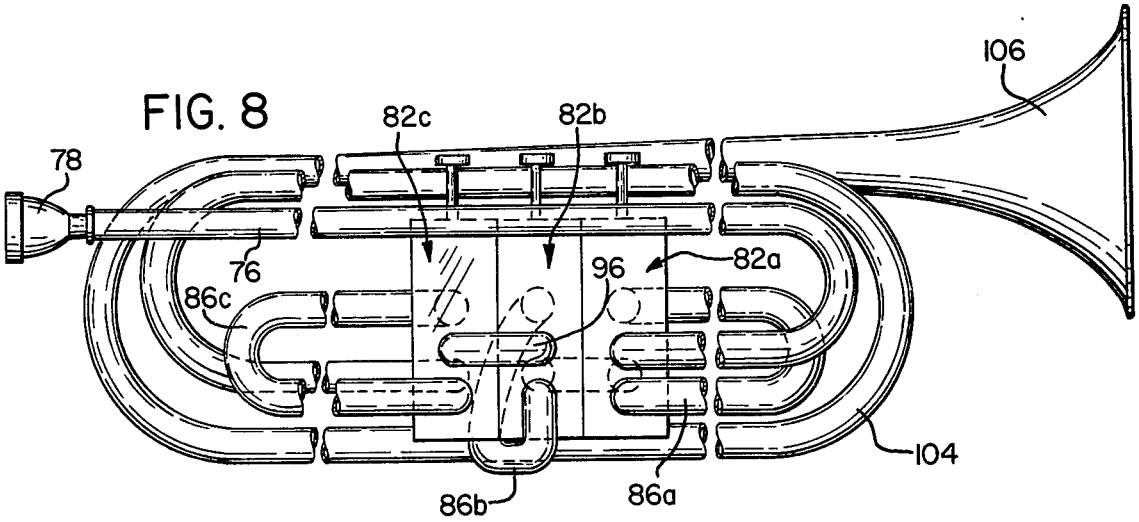

FIG. 7
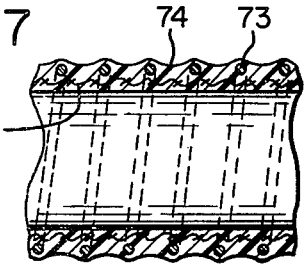
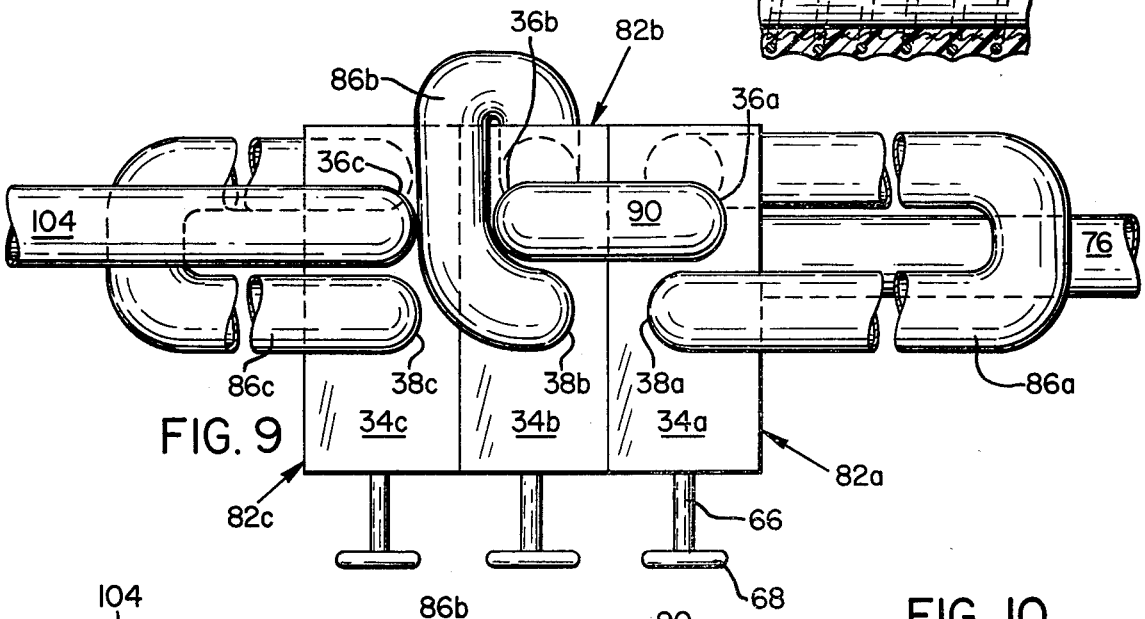
FIG. 9
FIG. 10
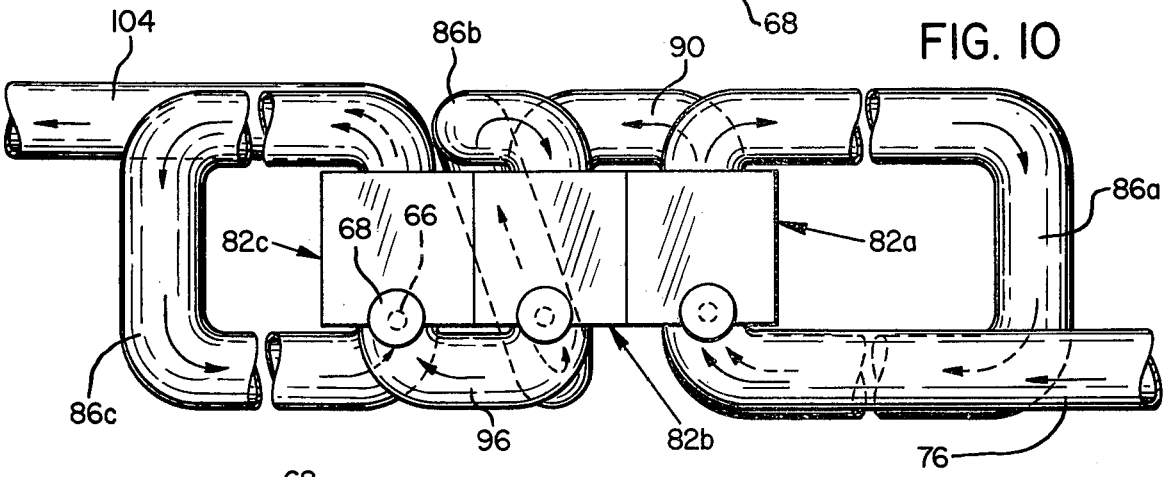
FIG. 11
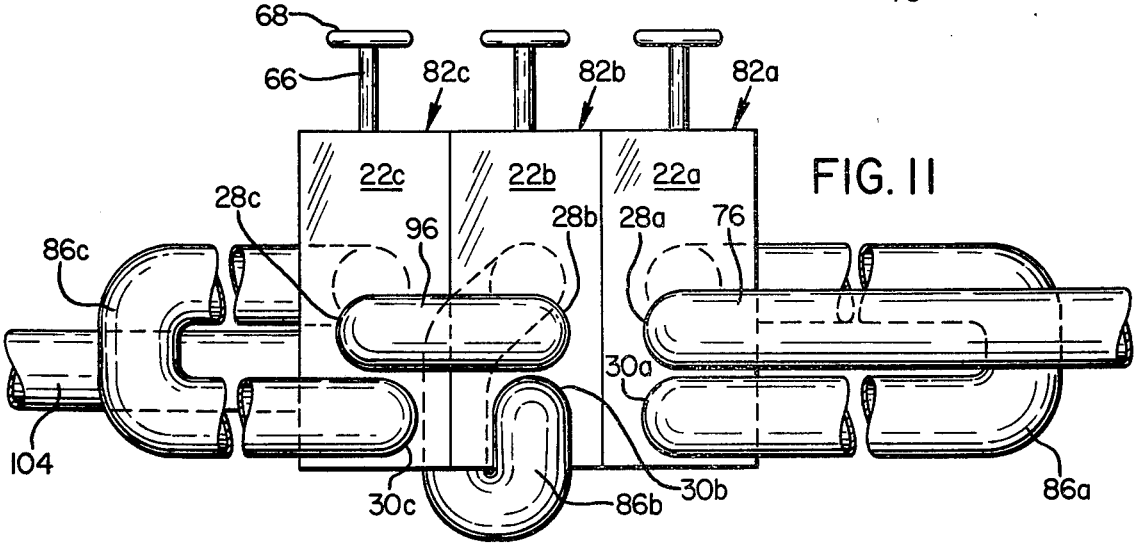

FLEXIBLE TUBE VALVE

BACKGROUND OF THE INVENTION

This invention relates to a flexible tube switch, and more specifically, to a flexible tube valve for use in a musical wind instrument.

Simple flexible tube switches have been used in musical instruments previously. For example, U.S. Pat. No. 3,933,078 to Veneklasen at FIGS. 11*a* and 11*b*, shows the use of such a switch in a French horn of unique design. Such prior art uses incorporate a single tube having one end fixed and the other end free to move between two positions. These switches are not suitable to replace the standard valves of a normal French horn, trumpet or similar brass instrument because they can only change the course of a single air passageway.

Standard brass wind instrument valves are either piston or rotary type valves which include a piston or rotor with multiple passages extending therethrough. When activated such valves interrupt the passage of sound waves from an instrument's lead pipe to its main bore by routing the waves from the lead pipe, through a slide loop, then back into the main bore. The pistons or rotors of such valves are typically machined from solid blocks of metal and include a variety of tortuous passages which are difficult to produce. Such standard valves require frequent lubrication and other maintenance.

SUMMARY OF THE INVENTION

The present invention is a valve which includes two flexible tubes within a single valve body. This new flexible tube valve performs the same task as a standard brass wind instrument valve, but may be constructed at lower cost and requires less maintenance.

It is an object of the present invention to provide a valve of simple design which can be made from a variety of materials, including synthetic plastics.

A further object is to provide a valve which is essentially maintenance free and which requires lubrication only infrequently.

An additional object is to provide a valve having flexible tubes which extend in a substantially straight path through the valve body.

Other advantages and objects of this invention will become apparent to those skilled in the art upon reading the specification.

BRIEF DESCRIPTION OF THE DRAWINGS

In the drawings:

FIG. 1 is a partially broken away side view of a valve according to the present invention with its slide plate in a first or raised position;

FIG. 2 is a partially broken away side view of the valve shown in FIG. 1 with its slide plate in a second or lowered position;

FIG. 3 is a top view of the valve shown in FIG. 1;

FIG. 4 is a sectional view taken along lines 4—4 of FIG. 1;

FIG. 5 is a sectional view taken along lines 5—5 of FIG. 2;

FIG. 6 is a sectional view taken along lines 6—6 of FIG. 2;

FIG. 7 is an enlarged, partial view of one of the flexible tubes shown in FIG. 2;

FIG. 8 is a plan view of a B-flat bass trumpet incorporating three valves of the type shown in FIG. 1;

FIG. 9 is an enlarged view of the valve assembly, including slide loops, of the trumpet shown in FIG. 7;

FIG. 10 is a top view of the valve assembly shown in FIG. 8; and

FIG. 11 is a back view of the valve assembly shown in FIG. 8.

DESCRIPTION OF THE PREFERRED EMBODIMENT

The valves of a brass wind musical instrument are adapted to selectively insert or remove a slide loop from the instrument's sound path. Each such valve includes a casing to which is connected a lead pipe which extends from a mouthpiece, a main bore which terminates in the instrument's bell, and both ends of the slide loop. Inside the casing is located a finger-actuated valve mechanism which can, alternately, connect the lead pipe directly to the main bore or connect opposite ends of the slide loop to the lead pipe and main bore respectively.

Interior details of the novel valve according to the present invention are shown in FIGS. 1 through 6. This valve has a casing 20 which includes a first end plate 22, the interior face of which defines an elongated contact surface 24. Primary and secondary contact surface apertures 28, 30 extend through the plate 22.

At the opposite side of the casing 20 is located a second flat end plate 34 which is parallel to the first end plate but spaced therefrom so that a valve chamber is formed between the two end plates. The second end plate 34 defines primary and secondary tube-anchoring apertures 36, 38.

Inside the casing is a primary flexible tube 42 which connects a primary slide plate aperture 50 defined by a slide plate 56 to the primary anchoring aperture 36. Also included inside the casing is a secondary flexible tube 46 which connects a secondary slide plate aperture 52 defined by the plate 56 to the secondary anchoring aperture 38.

The slide plate 56 has an elongated contact face 58 which is slidably positioned against the contact surface 24 in such a manner that the plate apertures at the contact face 58 and the surface apertures at the contact surface 24 are always located in a common plane. A shaft 66 extends upwardly from the slide plate 56 and terminates in a button 68 so that the slide plate can be manually moved between first and second playing positions.

As shown in FIG. 1, the slide plate 56 normally rests in a first or raised position wherein the primary slide plate aperture 50 registers with the primary surface aperture 28. When the button 68 is depressed, the slide plate moves to a second or lowered position wherein the primary slide plate aperture 50 registers with the secondary surface aperture 30 and the secondary slide plate aperture 52 registers with the primary surface aperture 28. Stops 69 at the top and bottom of the casing limit the travel of the slide plate 56 so that the appropriate slide plate apertures will exactly register with surface apertures when the button 68 is fully depressed and the primary plate aperture will exactly register the primary surface aperture when the button is released. Springs 70, inside the casing, urge the slide plate upwardly toward the first position and also horizontally toward the first end plate 22 so that the contact face 58 remains against the contact surface 24.

Flexible tubes for use with the aforesaid valve must easily compress longitudinally as the slide plate moves between its two positions. Suitable tubes, as shown in FIG. 7, comprise helical springs bound to a tubular elastomeric substrate. Such a tube may be formed by wrapping a mandrel with a layer of nylon mesh 72 of the type used in women's stockings, winding a nylon or glass filament 73 around the mesh to form a helix, and then coating the filament and mesh with a layer 74 of silicone cement which is flexible when set. After the cement sets and the mandrel is removed, to leave a tube that is radially firm, but highly longitudinally compressible.

Referring now to FIGS. 8 through 11, it can be seen how the previously described valve can be incorporated into a brass wind instrument. The instrument specifically shown is a B-flat bass trumpet which includes a lead pipe 76 extending from a mouthpiece 78 to a first of the three valves 82*a*, 82*b* and 82*c*. The lead pipe 76 joins the valve 82*a* at that valve's primary surface aperture 28*a* defined by an end plate 22*a*.

A connecting loop 90 extends from a primary anchoring aperture 36*a* of a second end plate 34*a* to a primary anchoring aperture 36*b* defined by a second end plate 34*b* of the second valve 82*b*, see FIGS. 9 and 10. A second connecting loop 96 extends from a primary surface aperture 28*b* through a first end plate 22*b* of the second valve 82*b* to a primary surface aperture 28*c* in a first end plate 22*c* of the third valve 82*c*. From a primary anchoring aperture 36*c* through a second end plate 34*c* extends the instrument's main bore 104 which terminates at the instrument's bell 106. All three valves have slide loops 86*a*, 86*b* and 86*c* which connect their secondary surface apertures 30*a*, 30*b* and 30*c* to their secondary anchoring apertures 38*a*, 38*b* and 38*c* respectively.

OPERATION

As was previously mentioned, the slide plate 56 of each valve may be moved between two alternate positions by moving that valve's finger button 68. When the plate 56 is in the first or raised position, a direct path is formed through tube 42 between primary anchoring and surface apertures 36 and 28 so that the most direct possible path exists between the main bore and the lead pipe of the musical instrument.

The sound path is lengthened by moving the valve slide plate 56 to the lowered or second position so that a slide loop 86 is included in the circuit between the lead pipe and the main bore. This predetermined increase in the sound path length allows the instrument to produce a note of a lower pitch. When the finger button 68 is released, the spring 70 pushes the slide plate 56 back up against the upper stop 69 so that the instrument returns to its higher pitch.

The efficient operation of valves according to the present invention is not affected by reversing the direction in which air flows through the valves. Of the valves shown in FIGS. 8–11, only the second valve 82*b* employs the air flow direction shown in FIGS. 1 and 2. Valves 82*a* and 82*c* use reverse flow patterns. In other words, sound waves flow into valves 82*a* and 82*c* through their primary surface apertures 82*a*, 28*c* and leave those valves through their primary anchoring apertures 36*a*, 36*c*.

While I have shown and described preferred embodiments of my invention, it will be apparent to those skilled in the art that changes and modifications may be made without departing from my invention in its broader aspects. Therefore the scope of the present invention should only be determined by the following claims.

I claim:

1. A slide valve for a musical instrument of the brass family type comprising:

a casing having a first end plate which defines primary and secondary contact surface apertures;

a first instrument pipe and a second instrument pipe;

a primary flexible tube having two ends;

a secondary flexible tube having two ends;

a key actuated tube positioning means connected to one end of said tubes and movable in relation to said casing between:

a. a first position in which said one end of said primary tube registers with said primary surface aperture, and b. a second position in which said one end of said primary tube registers with said secondary surface aperture and said one end of said secondary tube registers with said primary surface aperture;

a slide loop connected at one end to the outside of said first end plate, said second instrument pipe registering with said primary surface aperture, one end of said slide loop registering with said secondary surface aperture and the other ends of said primary and secondary tubes fixedly registering with said first instrument pipe and the other end of said slide loop, respectively; and resilient means biasing said tube positioning means to one of said positions.

2. A valve according to claim 1 wherein:

said casing also includes a second end plate which defines primary and secondary tube-anchoring apertures; and the other ends of said primary and secondary tubes connect with said primary and secondary anchoring apertures respectively.

3. A valve according to claim 2 wherein said first and second end plates are flat, extend parallel to each other and are positioned in an opposed, spaced relationship.

4. A valve according to claim 3 wherein all of said anchoring and surface apertures are located in a common plane.

5. A valve according to claim 4 wherein said plane is substantially perpendicular to said end plates.

6. A valve according to claim 4 wherein the centers of said anchoring apertures are equidistant from the center of said primary surface aperture.

7. A valve according to claim 2 wherein said resilient means comprises spring means operably connected between said slide plate and said second end plate to urge said flat face toward a position of engagement with said flat surface.

8. A valve according to claim 1 wherein:

said first end plate has an elongated contact surface through which said surface apertures extend;

said tube positioning means comprises a slide plate having an elongated contact face which lies against said contact surface;

said slide plate defines primary and secondary slide plate apertures each of which extends through said slide plate from said contact face to another face thereof;

said one ends of said primary and secondary tubes are connected with said primary and secondary slide plate apertures respectively at said another face;

said slide plate is slidable alongside said first end plate in such a manner that said slide plate apertures at said contact face and said surface apertures at said contact surface are always located in a common plane which intersects said contact face and contact surface; and said slide plate is slidable between a first position wherein said primary slide plate aperture registers with said primary surface aperture and a second position wherein said primary slide plate aperture registers with said secondary surface aperture and said secondary slide plate aperture registers with said primary surface aperture.

9. A valve according to claim 8 wherein:

one of said first end plate and said slide plate includes stop means; and the other of said first end plate and said slide plate includes means arranged for engaging said stop means to limit the travel of said slide plate so that said slide plate cannot move beyond said first and second positions.

10. A valve according to claim 8 wherein:

said contact face and said contact surfaces are planar; and said common plane is perpendicular to said contact face and said contact surface.

11. A valve according to claim 1 wherein said tubes include:

a tubular, flexible substrate layer which defines a sound passageway;

a flexible, substantially non-stretchable filament embedded in said layer and arranged in a helix about said passageway; and a mesh sheath embedded in said layer and arranged to surround said passageway.

12. A musical wind instrument comprising:

a lead pipe having a mouthpiece at one end thereof;

a main bore terminating in an instrument bell;

three slide loops;

three valve casings each of which defines secondary tube-anchoring and surface apertures connected respectively to opposite ends of one of said loops and primary tube-anchoring and surface apertures, said lead pipe being connected to one of said primary apertures of a first of said casings, the other of said primary apertures of said first casing being connected to one of said primary apertures of a second of said casings, the other of said primary apertures of said second casing being connected to one of said primary apertures of a third of said casings, and the other of said primary apertures of said third casing being connected to said main bore;

three flexible primary sound tubes, one of which is located within each said casing;

three flexible secondary sound tubes, one of which is located with each said casing; and three tube positioning means, one of which is located within each said casing and is operable to move said tubes associated with the said casing between:

a. a first position in which said primary sound tube directly connects said primary anchoring aperture to said primary surface aperture, and b. a second position in which said primary sound tube connects said primary anchoring aperture with said secondary surface aperture and said secondary sound tube connects said secondary anchoring aperture with said primary surface aperture.

13. A slide valve for a musical instrument of the brass family type comprising:

a casing having a first flat end plate having an elongated contact surface which defines primary and secondary contact surface apertures and a second flat end plate which is parallel to and spaced from said first end plate and which defines primary and secondary tube anchoring apertures;

a first instrument pipe, a second instrument pipe, and a slide loop connected to the outside of said casing, said first instrument pipe registering with said primary anchoring aperture, said second instrument pipe registering with said primary surface aperture, and the two ends of said loop registering with said secondary apertures, respectively;

a slide plate having an elongated contact face which lies alongside said contact surface, said slide plate defining primary and secondary slide plate apertures each of which extends through said slide plate from said contact face to another face thereof, said slide plate being slidable alongside said first end plate in such a manner that said slide plate apertures at said contact face and said surface apertures at said contact surface are always located in a common plane which is perpendicular to said contact face and contact surface, and said slide plate being slidable between a first position wherein said primary slide plate aperture registers with said primary surface aperture and a second position wherein said primary slide plate aperture registers with said secondary surface aperture and said secondary slide plate aperture registers with said primary surface aperture, one of said first end plate and said slide plate including stop means, and the other of said first end plate and said slide plate including means arranged for engaging said stop means to limit the travel of said slide plate so that said slide plate can move only between said first and second positions;

a primary flexible tube connecting said primary anchoring aperture and said primary slide plate aperture;

a secondary flexible tube connecting said secondary anchoring aperture and said secondary slide plate aperture;

a finger-actuated shaft mounted on said slide plate for moving said slide plate between said first and second positions; and spring means operably connected between said slide plate and at least one of said end plates to urge said slide plate toward one of said positions and to urge said contact face toward a position of engagement with said contact surface.

14. A valve according to claim 13 wherein the centers of said anchoring apertures are located in said common plane and are equidistant from the center of said primary surface aperture.

15. A musical wind instrument of the brass family type comprising:

a lead pipe having a mouthpiece at one end thereof;

a main bore terminating in an instrument bell;

a slide loop;

a casing to which said lead pipe, main bore, and opposite ends of said loop are connected;

flexible primary and secondary sound tubes located within said casing; and tube positioning means movable in said casing between:

a. a first position in which said primary sound tube directly connects said lead pipe to said main bore, and b. a second position in which said primary sound tube connects one end of said loop to one of said lead pipe and said main bore, and said secondary sound tube connects the other end of said loop to the other of said lead pipe and said main bore.

* * * * *